United States Patent [19]

Daley et al.

[11] Patent Number: 4,854,486

[45] Date of Patent: Aug. 8, 1989

[54] RESEALABLE CONTAINER FOR DISPENSING LIQUID

[75] Inventors: Richard J. Daley, Walpole; Robert S. Potts, Sherborn, both of Mass.

[73] Assignee: Ciba Corning Diagnostics Corp., Medfield, Mass.

[21] Appl. No.: 294,930

[22] Filed: Jan. 5, 1989

Related U.S. Application Data

[63] Continuation of Ser. No. 48,280, May 11, 1987, abandoned.

[51] Int. Cl.[4] ..... B67D 3/00

[52] U.S. Cl. ..... 222/484; 137/588; 222/478; 222/501

[58] Field of Search ..... 222/322, 400.7, 478, 222/181, 479, 185, 481, 481.5, 482, 484; 141/291, 293, 301, 302, 305, 349; 251/149.1, 149.6; 137/588; 285/3, 4, 133.1, 921

[56] References Cited

U.S. PATENT DOCUMENTS

| | | | |
|---|---|---|---|
| 1,017,756 | 2/1912 | Head | 137/588 X |
| 1,241,352 | 9/1917 | Doering et al. | 222/88 |
| 2,463,922 | 3/1949 | Turner | 222/479 X |
| 2,620,113 | 12/1952 | Bodendoerfer et al. | 141/305 X |
| 2,661,018 | 12/1953 | Snyder | 222/481.5 X |
| 2,661,019 | 12/1953 | Snyder et al. | 137/588 X |
| 2,724,535 | 11/1955 | Day et al. | 222/479 X |
| 2,963,205 | 12/1960 | Beall, Jr. | 222/484 |
| 3,155,126 | 11/1964 | Hi | 141/305 X |
| 3,308,798 | 3/1967 | Snider | 137/504 X |
| 3,343,699 | 9/1967 | Nicko | 222/541 X |
| 3,551,273 | 12/1970 | McKinney | 215/247 |
| 3,606,096 | 9/1971 | Campbell | 222/479 X |
| 4,077,429 | 3/1978 | Kimball | 137/588 |
| 4,353,488 | 10/1982 | Schneiter et al. | 222/501 |
| 4,408,701 | 10/1983 | Jeans | 222/478 X |

*Primary Examiner*—Kevin P. Shaver

*Attorney, Agent, or Firm*—William G. Gosz

[57] ABSTRACT

A resealable liquid delivery system for dispensing liquid from a container, such as a bottle, consists of a seal assembly positioned below the level of the liquid in the container, and a dispensing probe. The seal assembly consists of an upper elastomeric member and a seating member disposed within the upper elastomeric member. The seal assembly is capable of accepting and retaining insertion of the dispensing probe.

16 Claims, 3 Drawing Sheets

RESEALABLE CONTAINER FOR DISPENSING LIQUID

This application is a continuation of prior U.S. application Ser. No. 048,280, filing date May 11, 1987 and now abandoned.

FIELD OF THE INVENTION

This invention relates to a novel liquid delivery system and, more particularly, to a resealable liquid delivery system for dispensing system from an inverted container.

BACKGROUND OF THE INVENTION

Effective systems for dispensing or delivery of liquid reagents from containers to sample holders are necessary for the efficient operation of many analytical instruments. Such systems should provide on demand delivery of liquids, be resealable and be reusable. Known systems for such delivery of liquids, such as systems using septums and needles, suffer from certain disadvantages, such as limited resealability and reusability, handling difficulties or septum bleed.

Accordingly, it is the object of this invention to provide a novel liquid delivery system.

It is also an object of this invention to provide a novel liquid delivery system that is resealable and reusable.

SUMMARY OF THE INVENTION

This invention relates to a liquid delivery system positioned below the level of the liquid in a container, comprising:

(a) a seal assembly comprising an upper elastomeric member in contact with the liquid in a container, having at least one liquid passage vent and at least one air passage vent separate from the liquid passage vent; a seating member disposed below the upper elastomeric member which is configured to receive a dispensing probe, thereby allowing communication between the dispensing probe and the upper elastomeric member and in the absence of a dispensing probe, to reversibly seal the liquid passage vent; means for preventing the liquid from entering the air passage vent; and means for reversible retention of a dispensing probe within the seal assembly; and (b) a dispensing probe having at least one air inlet and at least one liquid outlet separate from the air inlet, which dispensing probe is capable of insertion into and reversible retention within the seal assembly, wherein insertion of the dispensing probe into the seal assembly causes the upper elastomeric member to flex away from the seating member, thereby opening the liquid passage vent, establishing communication between the liquid passage vent and the liquid outlet, and allowing the liquid to flow from the container through the liquid passage vent into the liquid outlet; and also establishes communication between the air inlet and the air passage vent, thereby allowing air to flow through the air inlet and the air passage vent into the container to replace the liquid which has flowed from the container; and wherein removal of the inserted dispensing probe from the seal assembly causes the upper elastomeric member to resume contact with the seating member, thereby sealing the liquid passage vent, and preventing liquid flow.

DESCRIPTION OF THE INVENTION

As illustrated in FIGS. 1–4, one preferred embodiment of the liquid delivery system of this invention comprises a seal assembly 1 and a probe 2.

Figure 1:
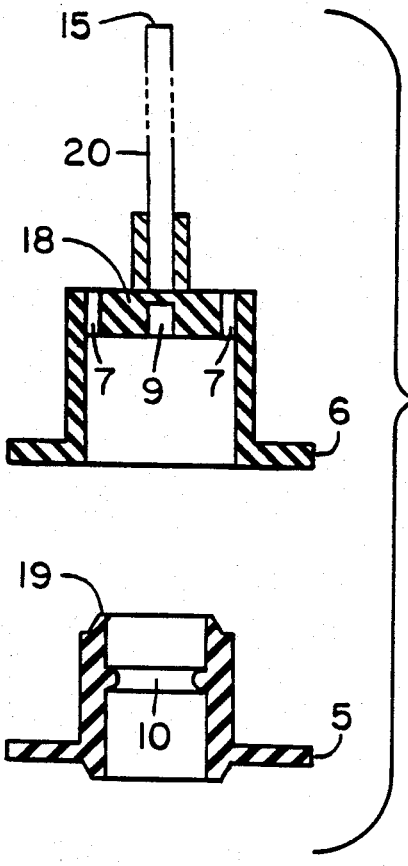
FIG. 1 is a cross-sectional fragmentary view of the upper elastomeric member and the seating member of a seal assembly according to one preferred embodiment of this invention.

In FIG. 1, the upper elastomeric member 6 and the lower seating member 5, which is also elastomeric, of the seal assembly 1 are separated. The upper elastomeric member 6 comprises a plurality of liquid passage vents 7, an air passage vent having a vent entrance 9 and a vent exit 15, a vent tube 20, and an upper elastomeric member crown 18. The liquid passage vents 7 and air passage vent entrance 9 are located in the upper elastomeric member crown 18. The elastomeric lower seating member 5 comprises a retaining lip 10 and a seating member crown 19. The seating member 5 inserts into the upper elastomeric member 6 to form seal assembly 1.

Figure 2:
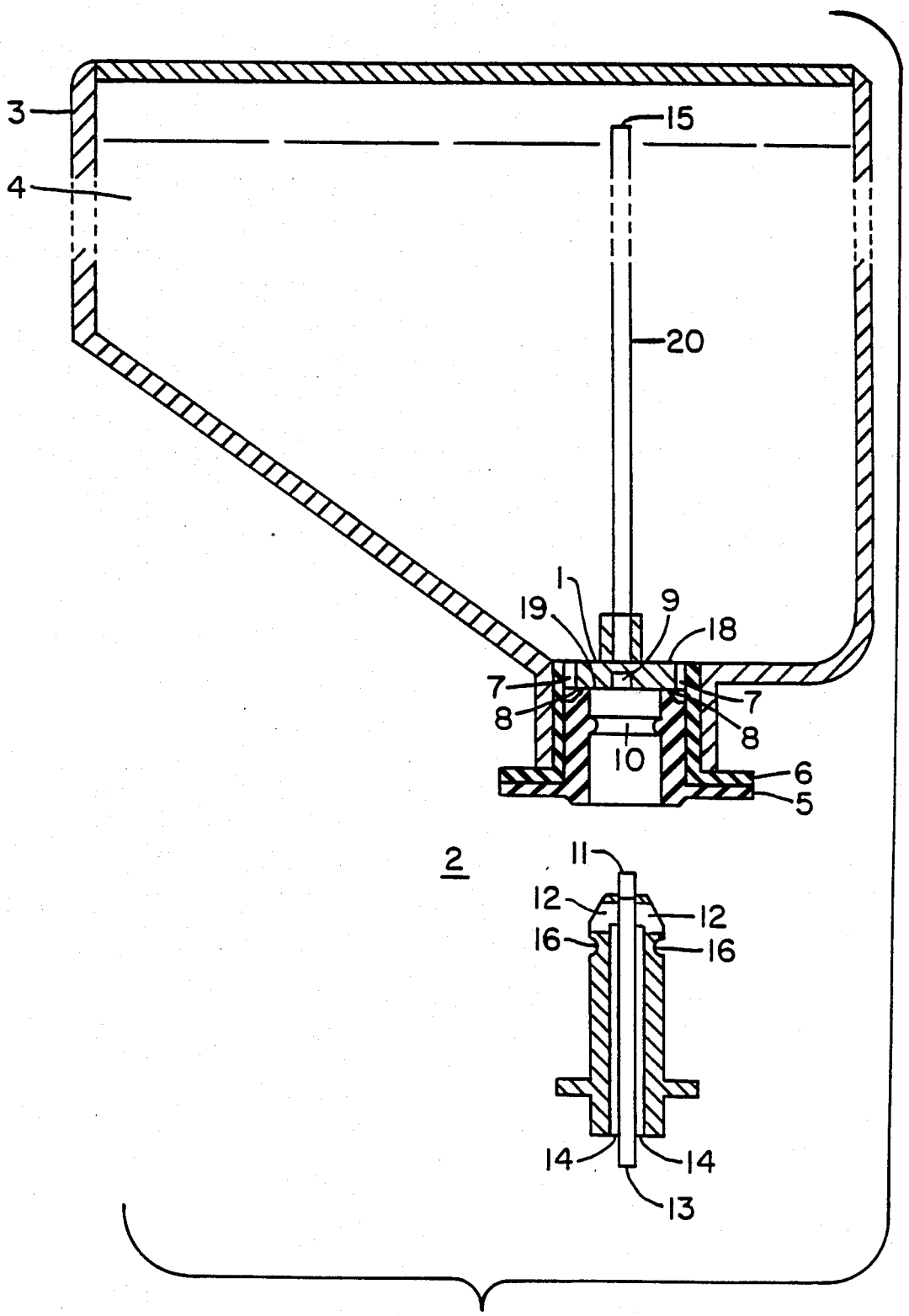
FIG. 2 is a cross-sectional fragmentary view of a dispensing probe and the seal assembly illustrated in FIG. 1 positioned in the neck of an inverted bottle containing liquid, prior to insertion of the dispensing probe into the seal assembly.

In FIG. 2, the seating member 5 has been inserted into the upper elastomeric member 6 and the seating member crown 19 is in contact with the upper elastomeric member crown 18 to form liquid passage vent seals 8. The seal assembly 1 has been inserted into the neck of an inverted bottle 3. The air passage vent exit 15 is situated above the level of the liquid 4 in bottle 3. The seating member 5 is securely inserted within the upper elastomeric member 6 of the seal assembly 1 and the seal assembly 1 is securely inserted within the neck of bottle 3 to prevent any leakage of liquid 4 from bottle 3.

The dispensing probe 2 comprises a plurality of liquid outlet entrances 12 and liquid outlet exits 14, an air inlet entrance 13, an air inlet exit 11, and a retaining groove 16.

Figure 3:
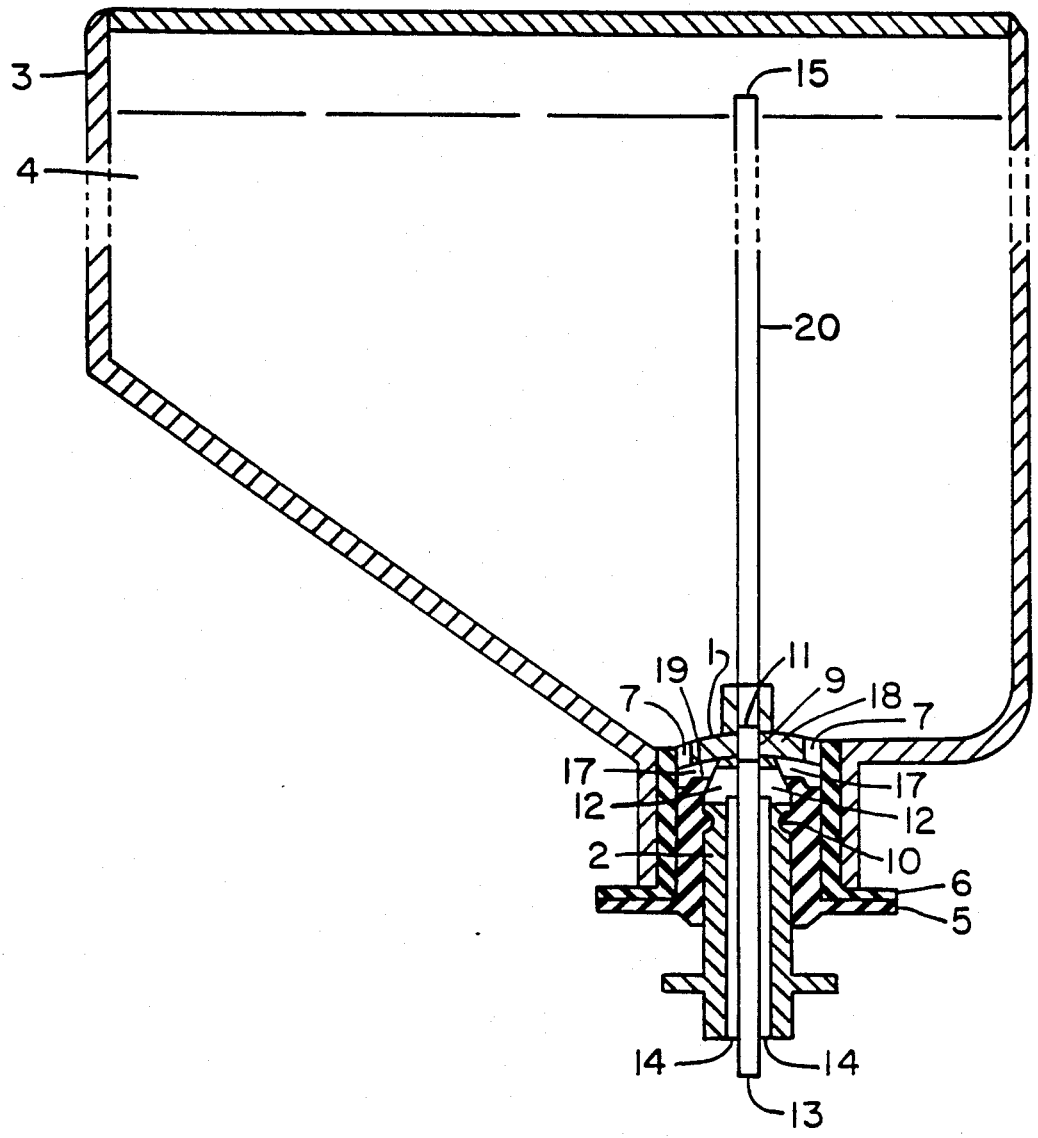
FIG. 3 is a cross-sectional fragmentary view of the probe and seal assembly illustrated in FIG. 2, after insertion of the probe into the seal assembly.

In FIG. 3, the dispensing probe 2 has been securely inserted into the seal assembly 1, causing the upper elastomeric member crown 18 of the seal assembly 1 to flex away from the seating member crown 19, thereby breaking the liquid vent seals 8 and creating space 17. The liquid 4 in the bottle 3 then flows from the bottle 3, into the liquid vents 7, into space 17, into the liquid outlet entrances 12, and finally, out the liquid outlet exits 14. In a preferred embodiment of this invention, tubing is connected to the liquid outlet exits 14 to transport the liquid 4 to the desired receptacle. As the liquid 4 flows from the bottle 3, air enters the air inlet entrance 13, passes through the air inlet exit 11 into the air passage vent entrance 9, into the vent tube 20, and through the air passage vent exit 15 into the bottle 3. Other means are available for separating the air passage vent from the liquid.

The dispensing probe 2 is reversibly retained within the seal assembly 1 by inserting the dispensing probe 2 into the seal assembly 1 such that the retaining lip 10 seats in form fitting engagement with the surface of the retaining groove 16 of the dispensing probe 2. Other means for retention of the dispensing probe within the seal assembly are available.

When the dispensing probe 2 is removed from the seal assembly 1, the upper elastomeric member crown 18 resumes contact with the seating member crown 19 eliminating space 17, thereby reforming the liquid passage vent seals 8 and stopping liquid flow.

Figure 4A:
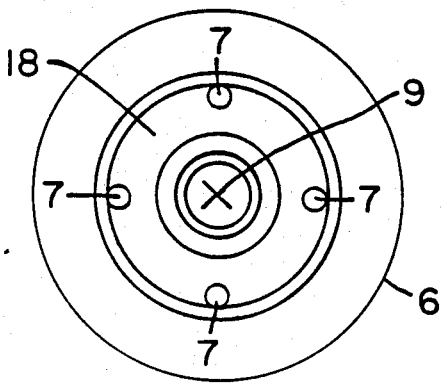
FIG. 4A is a top end view of the upper elastomeric member of the seal assembly illustrated in FIG. 1
Figure 4B:
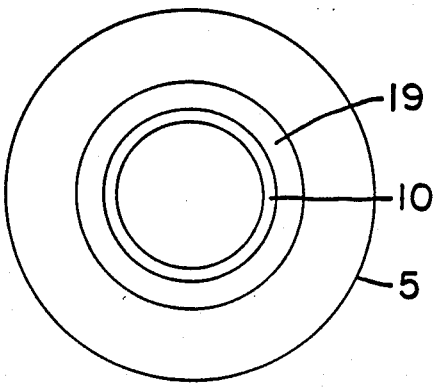
FIG. 4B is a top end view of 4B is a top end view of FIG. the seating member of the seal assembly illustrated in FIG. 1 of the seal assembly illustrated in FIG. 1.

In FIG. 4A, four liquid passage vents 7 and one reasonable air passage vent entrance 9 are located in the upper elastomeric member crown 18 of the upper elastomeric member 6 of the seal assembly 1. FIG. 4B illustrates the seating member crown 19 and the retaining lip 10 of the seating member 5 of the seal assembly 1.

It will be apparent to one having ordinary skill in the art that many variations are possible without departing from the spirit and scope of the present invention.

What is claimed is:

1. A seal assembly for a liquid delivery system positioned below the level of the liquid in a container, comprising an upper elastomeric member in contact with the liquid in a container, said upper elastomeric member having at least one liquid passage and at least one air passage separate from the liquid passage, and having means for preventing the liquid from entering the air passage; and a seating member disposed below and in contact with the upper elastomeric member, said seating member being configured to receive a dispensing probe, and having means to seal the liquid passage and means for engaging and retaining a dispensing probe within the seal assembly.

2. A seal assembly as recited in claim 1 wherein the seating member is elastomeric.

3. A seal assembly as recited in claim 1 wherein there are a plurality of the liquid passages.

4. A seal assembly as recited in claim 1 wherein the seal assembly comprises means to reseal the air passage.

5. A liquid delivery system positioned below the level of the liquid in a container comprising:

(a) a seal assembly comprising an upper elastomeric member in contact with the liquid in a container, said upper elastomeric member having at least one liquid passage and at least one air passage separate from the liquid passage, and having means for preventing the liquid from entering the air passage; and a seating member disposed below and in contact with the upper elastomeric member, said seating member being configured to receive a dispensing probe, and having means to seal the liquid passage and means for engaging and retaining a dispensing probe within the seal assembly, and;

(b) a dispensing probe having at least one air inlet and at least one liquid outlet separate from the air inlet, said dispensing probe having complementary means for engagement and retcntion within the seal assembly, wherein insertion of the dispensing probe into the seal assembly causes the upper elastomeric member to flex away from the seating member, thereby establishing communication between the liquid passage and the liquid outlet, allowing the liquid to flow from the container through the liquid passage into the liquid outlet, and wherein said insertion also establishes communication between the air inlet and the air passage, allowing air to flow through the air inlet and air passage into the container to replace liquid which has been removed from the container and wherein removal of the inserted dispensing probe from the seal assembly causes the upper elastomeric member to resume contact with the seating member, thereby sealing the liquid passage and preventing liquid flow.

6. A liquid delivery system as recited in claim 5 wherein the seating member is elastomeric.

7. A liquid delivery system as recited in claim 5 wherein the seal assembly comprises means to reseal the air passage.

8. A liquid delivery system as recited in claim 5 wherein there are a plurality of the liquid passages.

9. A liquid delivery system as recited in claim 8 wherein there are a plurality of the liquid outlets.

10. A liquid delivery system comprising:

(a) a container of liquid;

(b) a seal assembly comprising an upper elastomeric member in contact with the liquid in a container, said upper elastomeric member having at least one liquid passage and at least one air passage separate from the liquid passage, and having means for preventing the liquid from entering the air passage; and a seating member disposed below and in contact with the upper elastomeric member, said seating member being configured to receive a dispensing probe, and having means to seal the liquid passage and means for engaging and retaining a dispensing probe within the seal assembly, and;

(c) a dispensing probe having at least one air inlet and at least one liquid outlet separate from the air inlet, said dispensing probe having complementary means for engagement and retention within the seal assembly, wherein insertion of the dispensing probe into the seal assembly, wherein insertion of the dispensing probe into the seal assembly causes the upper elastomeric member to flex away from the seating member, thereby establishing communication between the liquid passage and the liquid outlet, allowing the liquid to flow from the container through the liquid passage into the liquid outlet, and wherein said insertion also establishes communication between the air inlet and the air passage, allowing air to flow through the air inlet and the air passage into the container and wherein removal of the inserted dispensing probe from the seal assembly causes the upper elastomeric member to resume contact with the seating member, thereby sealing the liquid passage and preventing liquid flow.

11. A liquid delivery system as recited in claim 10 wherein the seating member is elastomeric.

12. A liquid delivery system as recited in claim 10 wherein there are a plurality of the liquid passages.

13. A liquid delivery system as recited in claim 10 wherein there are a plurality of the liquid passages.

14. A liquid delivery system as recited in claim 10 wherein the seal assembly comprises means to reseal the air passage.

15. A liquid delivery system as recited in claim 10 wherein the container is an inverted bottle.

16. A liquid delivery system as recited in claim 15 wherein the seal assembly is located in the neck of the inverted bottle.

* * * * *